United States Patent [19]

Meintzer, Jr. et al.

[11] Patent Number: 4,986,524

[45] Date of Patent: Jan. 22, 1991

[54] LABEL INJECTOR FOR HEMMING MACHINES

[75] Inventors: John C. Meintzer, Jr., Milner; Michael E. Chandler, Meansville, both of Ga.

[73] Assignee: Dundee Mills, Inc., Griffin, Ga.

[21] Appl. No.: 293,210

[22] Filed: Jan. 4, 1989

[51] Int. Cl.[5] ..... B65H 3/08

[52] U.S. Cl. ..... 271/100; 271/104; 271/106; 271/107; 271/112; 271/132; 221/211; 112/322; 112/303; 112/113

[58] Field of Search ..... 271/99, 100, 104, 105, 271/106, 107, 112, 132, 137, 94, 34, 35, 162; 112/265.1, 322, 303, 115, 113, 104; 221/211; 414/797.7, 797.8, 797.6

[56] References Cited

U.S. PATENT DOCUMENTS

| | | | |
|---|---|---|---|
| 3,616,093 | 10/1971 | Teed | 112/104 X |
| 3,990,696 | 11/1976 | Landa | 271/94 |
| 4,157,692 | 6/1979 | Brocklehurst et al. | 271/20 X |
| 4,305,338 | 12/1981 | Adamson | 112/113 |
| 4,462,745 | 7/1984 | Johnson et al. | 271/94 X |
| 4,505,467 | 3/1985 | Brocklehurst | 271/11 X |
| 4,590,872 | 5/1986 | Bray | 271/11 X |
| 4,682,556 | 7/1987 | Block | 112/265.1 |

FOREIGN PATENT DOCUMENTS

| | | | |
|---|---|---|---|
| 771408 | 10/1934 | France | 271/94 |

*Primary Examiner*—David H. Bollinger

*Attorney, Agent, or Firm*—Jones, Askew & Lunsford

[57] ABSTRACT

A label injector for placing labels in the hems of towels, or the like, is disclosed. The labels are extracted from a vertical magazine onto the surface of a wheel by a combination of suction into openings on the surface of the wheel and upward movement of the magazine. The wheel is then rotated until the extracted label passes through a slot in the adjacent hemming track into the hem being folded. Suction is terminated, releasing the label, and the wheel is returned to its original orientation to receive another label. Other embodiments disclose a magazine for double thickness labels, and an applicator carrying a belt in a peripheral groove to assist in moving the labels.

29 Claims, 8 Drawing Sheets

37
48
45
47
47
48
10
2
48
2
23
34
22
20
35
53
18
28
55
60
104
25
52
95
49
80
56
75
78
67
88
66
65
70

37
38
39
42
36
47
48
50
35
53
102
31
23
25
52
78
80
30
18
20
70
98
99
83
12
83
14
15

37
10
36
38
50
43
39
36
42
33
45
50
34
35
23
30
26
24
31
28
25
20
47
47
56
55
104
48
61
49
49
60
87
88
62
63
67
70
65

LABEL INJECTOR FOR HEMMING MACHINES

TECHNICAL FIELD

The present invention relates to an apparatus and method for placing labels in position for being sewn onto a moving textile web, such as a towel, and more particularly relates to placing labels into the folds of a hem before the hem is sewn.

BACKGROUND ART

Manufacturers of web-like textile products, such as towel, blankets and sheets, usually sew an identifying label into a hem of the product. Many manufacturers utilize automatic equipment which moves the product past a folding device and then a sewing machine to form and sew the hem. The label can be inserted manually into the folds of the hem before sewing, or one of several automatic label injecting machines can be used. In general, the problems faced when automating the label injection process include the difficulty of withdrawing one label at a time from a supply of labels, presenting the label in proper orientation to the textile product during the formation of the folds of the hem, and preventing the motion of the product from disorienting the label before it can be sewn in place.

U.S. Pat. No. 4,1571,692 discloses a label dispensing system which removes from a vertical stack contained in a housing by bowing the bottom label down to a suction head which grasps the label. Then the suction head moves in an arc lying in a plane perpendicular to the path of a towel through about 180 degrees, to a positioning suspending the label over the path of the towel. When an approaching towel is detected, a separate clamp traps the label against the towel as the suction is terminated, and the suction head returns to a position below the stack of labels.

This system requires many moving parts, first to assure that only one label is acquired by the suction head, and also because the suction cannot simply deposit the label on the towel. The transverse relative movement of the suction head could tend to catch the label on the towel, causing the label to be misaligned. Thus, the head must suspend the label above the towel. Nor can the suction head simply drop the label onto the towel, because the movement of the towel could cause misalignment. Even if the towel were stopped for placement of the label, an inefficient step leading to increased cost, the label could float out of alignment.

Other swinging suction head systems have turned the arc of the suction head into the plane parallel to the path of the towel, but many of the same problems are still encountered. In one such system, the label dispenser is slightly inclined to the horizontal, and the suction head is operated to move into the magazine to engage the next label, pull it out of the magazine, and swing it down to the path of the towel. The label passes through a slot in the hemming track that folds the edge of the towel in a hem. This system requires complex control apparatus to precisely time the movement of the suction head.

Another automatic label handling system is disclosed in U.S. Pat. No. 4,505,467, according to which a suction head pulls a label off the bottom of an inclined dispenser holding a plurality of labels. A fork moving in the plane of the label then pushes the label off the suction head, after which it drops into an inclined chute where it is trapped by belts and fed down onto the towel. Another belt picks up the label in a conventional manner and holds it on the towel along the path to the sewing needle. It may be seen that this device depends upon the fork sliding the label off the suction head without folding or buckling the label, and releasing the label to let it free fall into the chute, all without changing the orientation of the label. Again, a relatively large number of moving parts is required, and it appears they must be carefully aligned to result in the label reaching the towel in proper alignment with the hem. IN practice, problems have arisen with one version of this system in which the belts in the chute were driven by the movement of the towel. The belts in the chute tended to lose synchronization of speed and to turn the labels travelling down to the towel.

Other label handling systems are shown in U.S. Pat. Nos. 4,305,338; 4,590,872; and 4,682,446. These systems position labels for sewing, but do not relate to inserting labels in hems.

Thus, there has long been a need in the art for a label injector capable of selecting a single label from a supply of labels and placing the label with consistent accuracy into the hem of a moving towel or other textile item, without slowing down the production rate of towels being hemmed. There has also been a need for such a label injector which has few moving parts, and can easily be moved away from the path of the towels to permit access to the injector and to other parts for maintenance.

SUMMARY OF THE INVENTION

The present invention addresses the problems in the prior art by providing a label injection system in which an applicator member grasps a label and moves it into contact with a moving workpiece, such as a towel, for sewing into a hem, without disrupting the orientation of the label. The system is consistently accurate in selection of one label at a time, and in placement of the labels on the workpiece, although it is less complex than prior, less consistent, devices.

Generally described, the present invention provides an apparatus for placing labels or the like onto a moving workpiece, comprising a magazine containing a plurality of the labels; an applicator wheel positioned between the magazine and the workpiece and rotatable about an axis perpendicular to the direction of movement of the workpiece, the applicator wheel including means for removing a label from the magazine and retaining the label on the applicator wheel; means for rotating the applicator wheel relative to the workpiece while the label is retained on the applicator wheel until the label is located between the applicator wheel and the workpiece; and means for releasing the label from the applicator wheel, whereby the label is placed upon the workpiece.

In the preferred embodiment of the invention, the wheel may define a peripheral surface for receiving the label, and the means for removing and retaining the label may comprise means for creating suction through an opening in the peripheral surface toward the interior of the wheel. Preferably, the peripheral surface defines a flattened portion surrounding the opening and a shoulder along the trailing edge of the flattened portion. The peripheral surface may further define a circumferential groove and a belt positioned in the groove, the belt crossing the opening and extending above the peripheral surface to engage the label. There is no need to stop the workpiece as the label is applied, because the peripheral surface can be moved at substantially the same speed as the workpiece.

In the preferred embodiment, the means for removing and retaining the label comprises means for creating suction through an opening in the peripheral surface toward the interior of the wheel. The means for creating suction can comprise a hollow axle with which the wheel rotates, a radial bore connecting the interior of the axle with the opening, and means for passing air through the axle across the entrance to the radial bore. The operation of the apparatus can be activated responsive to detection of an approaching workpiece.

The present invention also provides an apparatus for sequentially removing labels or the like, comprising a magazine containing a plurality of the labels, the magazine including a withdrawal opening and a lip extending partly across the withdrawal opening in the path of the labels; a suction head positioned adjacent to the withdrawal opening, the suction head being capable of grasping the label present at the withdrawal opening; and means for moving the magazine away from the suction head, such that the label grasped by the suction head is pulled from behind the lip and removed from the magazine. This feature of the invention assists greatly in assuring that one label at a time is removed from the magazine.

The present invention also provides a method of placing labels or the like onto a moving workpiece, generally comprising the steps of withdrawing a label from a magazine by applying suction to the label from an opening on the peripheral surface of a wheel positioned between the magazine and the workpiece; retaining the label on the wheel; moving the wheel relative to the workpiece while the label is retained on the peripheral surface until the label is positioned between the wheel and the workpiece; and releasing the label from the wheel, whereby the label is placed upon the workpiece.

Thus it is an object of the present invention to provide an improved apparatus and method for placing labels or the like onto a workpiece, such as a towel, or other textile web, for attachment to the workpiece.

It is a further object of the present invention to provide a label injector which accurately places labels into the hem of a moving textile web or other workpiece.

It is a further object of the present invention to provide a label injector which transfers a label from a label magazine to a textile web without passing the label between different parts of the injector or releasing the label prior to its placement on the textile web.

It is a further object of the present invention to provide a label injector which consistently retrieves a single label from a magazine and consistently places the label in the proper orientation on a moving textile web.

It is a further object of the present invention to provide a label injector which can be accessed easily for maintenance, removed easily when necessary, and replaced without any need to readjust the injector relative to the sewing apparatus on which it is mounted.

Other objects, features, and advantages of the present invention will become apparent upon reading the following detailed description of embodiments of the invention, when taken in conjunction with the accompanying drawing and the appended claims.

DETAILED DESCRIPTION

Figure 1:
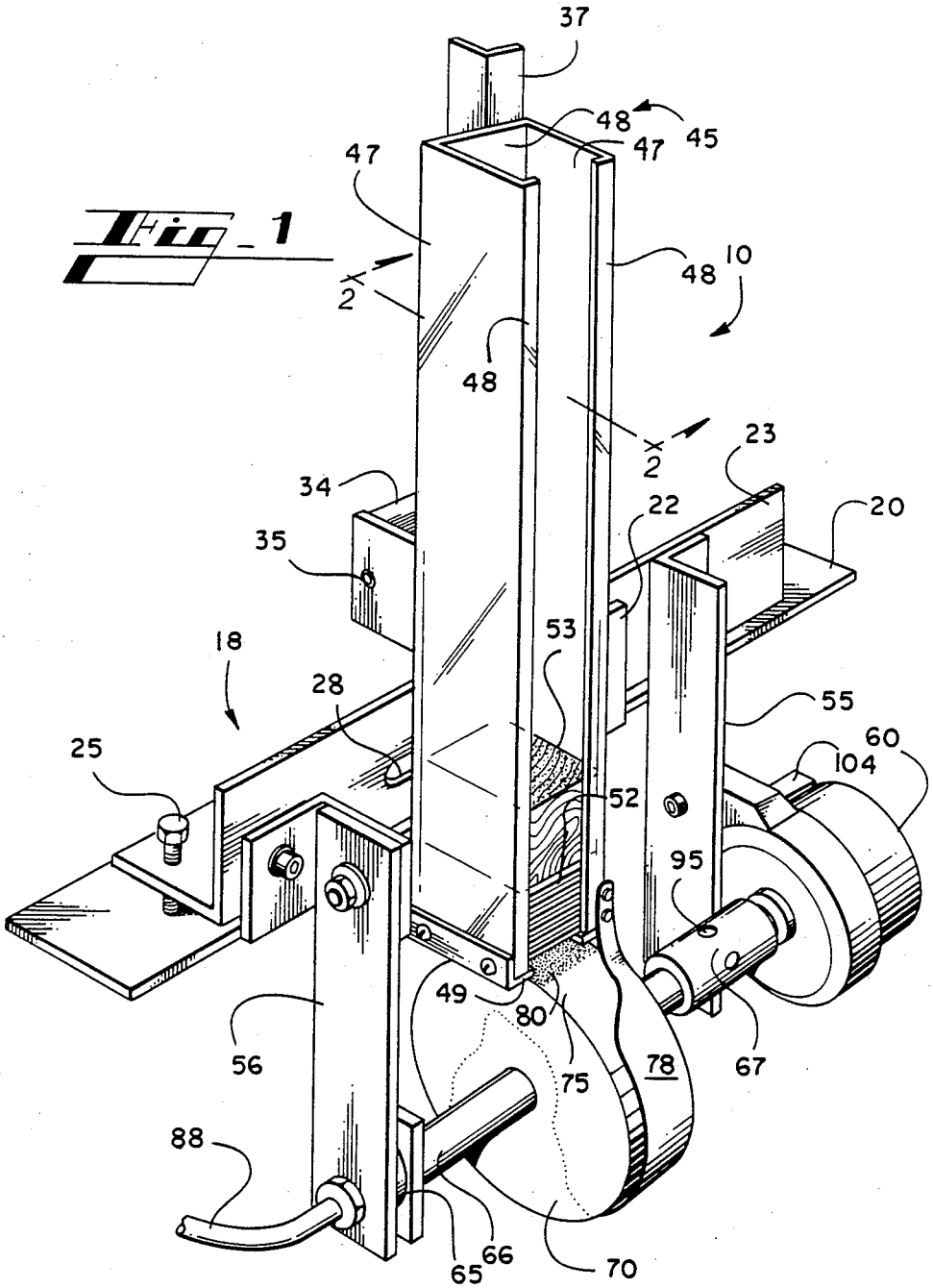
FIG. 1 is a pictorial view of a label injector embodying the present invention.

Referring now in more detail to the drawing, in which like numerals refer to like parts throughout the several views, FIG. 1 shows a label injector apparatus 10 embodying the present invention. The label injector 10 is positioned upstream of a sewing machine needle 12 above a table 14, along which a towel 15, or other workpiece, is being moved toward the sewing machine needle.

The label injector 10 includes a frame 18 which supports and allows adjustment of the moving parts of the label injector. The frame, shown in FIGS. 1–5, includes a horizontal mounting plate 20, which is rigidly clamped by means (not shown) to the structure of the table 14. A vertical mounting plate 22 defining a vertical slot therein is welded to the front edge of the horizontal mounting plate 20, and extends upwardly. A length of angle iron 23 is connected to the vertical plate 22 by a bolt 24. It will be seen that by loosening the bolt 24, the height of the angle 23 can be adjusted along the slotted plate 22, and the tilt of the angle 23 can be adjusted by rotation about the bolt 24. To stabilize the tilt position of the angle 23, a pair of set screws 25 and 26 at opposite ends of the angle 23 are tapped through the angle 23 until they engage the top surface of the horizontal plate 20.

The angle 23 defines a horizontal slot 28 near its center, and a vertical support member 30 is adjustably mounted to the angle by means of a bolt 31 passing through the slot 28 and threaded into a tapped hole in the vertical member 30. A magazine support member 33 is pivotally attached to the vertical member 30 by a conventional pivot joint 34 which can be locked in position by a locking screw 35. The support member 33 preferably is a vertically oriented angle ion defining a flange 37 which extends rearwardly in a plane at right angles to the length of the angle 23. A pneumatic cylinder 38 is mounted on the flange 37 with a piston rod 39 extending downwardly from the cylinder 38 and being biased in the down position by a spring 40 shown in FIG. 6. The cylinder 38 is provided with air pressure through a supply line 43 in a manner described below. A pair of vertical slots 36 are provided in the magazine support member 33. The front surface of the support member is preferably coated with a friction-reducing material such as Teflon tape.

A label magazine 45 includes a back wall 46, a pair of side walls 47, and a pair of front flanges 48, which together form an elongate, upstanding channel in which labels 52 can be stacked. In the embodiment shown in FIG. 1 a pair of inwardly directed lips 49 are mounted at the bottom of the side walls 47, to prevent the labels from falling out of the magazine 45. The magazine 45 is slidably attached to the magazine support member 33 by a pair of mounting screws 50 passing through the slot 36 into tapped holes in the support member 33, but not tightly binding the magazine against the support member. The vertical position of the piston rod 39, which is removably connected to the back wall 48 by a horizontal screw 41 which passes from the interior of the magazine 45 through the back wall 48 and passes through a ring 42 attached to the end of the piston rod 39. As will be explained in detail below, the operation of the piston rod reciprocates the magazine vertically along the slots 36 during operation of the label injector 10, preferably a distance of about one-half inch.

It may thus be seen that the magazine 45 may be moved horizontally along the slot 28 and tilted from side to side by rotation about the bolt 31 independently of the tilting of the angle 23, and locked by the bolt 31. It may also be tilted front to back about the pivot joint 34 and held in position by the locking screw 35.

The walls of the magazine 45 are preferably made of a smooth material such as plexiglass or stainless steel, so that the labels 52 will not bind as they make their way down the magazine. A follower 53 may be place on top of stack of labels 52 in the magazine to maintain the orientation of the labels and provide some weight forcing the bottom label against the lips 49. This assists in assuring that only one label at a time is retrieved by the suction apparatus described below.

A pair of mounting brackets 55 and 56 extend downwardly from the angel 23 on opposite sides of the magazine 45. At the bottom of the bracket 55, a conventional pneumatic rotary actuator 60 is mounted. The rotary actuator 60 may be, for example, that sold under the brand name FESTO DSR16-182. The function of the device is to rotate a shaft 61 through a certain arc (which is adjustable ) and to return the shaft to its original position. The rotary actuator 60 is supplied with air under pressure through two air lines 62 and 63 for providing rotary motion in opposite directions.

A bearing 65 is mounted at the bottom of the other bracket 56. Journalled in the bearing 65 is a hollow axle 66, which extends to a coupling 67 which joins the axle 66 to the shaft 61 of the rotary actuator 60. At its central portion, the axle 66 passes through an applicator wheel 70, which defines an axial bore 71 for receiving the axle 66. The rotary actuator 60 causes the wheel 70 and axle 66 to move together as the axle turns within the bearing 65.

Figure 6:
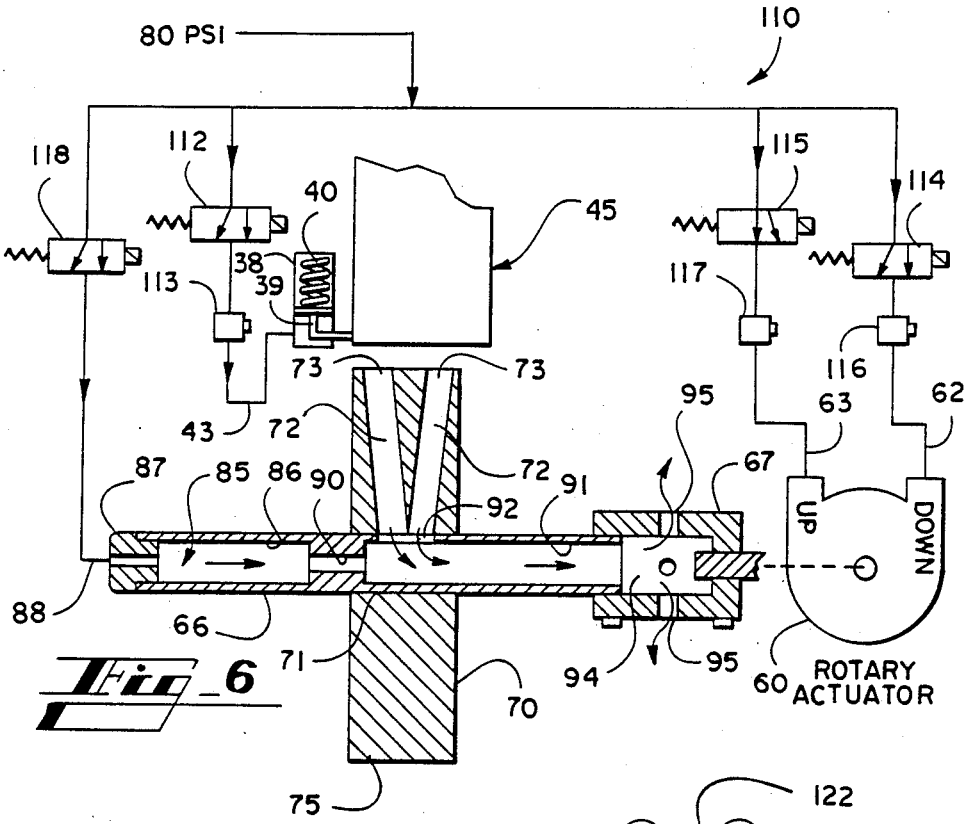
FIG. 6 is a schematic representation of the pneumatic control circuit of the present invention, also showing the interior detail of the applicator wheel and hollow axle.

The applicator wheel 70 also defines a pair of radial bores 72, shown in FIG. 6, which communicate with the axial bore 71 at one end, and extend while diverging in the shape of a "V" to a pair of openings 73 in the peripheral surface 75 of the wheel 70. An exemplary wheel, without limitation thereto, might have a diameter of three inches, a peripheral surface one inch wide, and two bores 72 each having a diameter of three-eights of an inch.

As shown in FIGS. 1, 2, 4, and 5, the applicator wheel 70 is positioned between the bottom of the magazine 45 and the top of the workpiece 15. The wheel is offset from the center of the magazine toward the center of the workpiece. A flattened area or suction platform 80 is formed surrounding the location of the openings 73 in the peripheral surface 75, creating a shoulder 81 at the trailing edge of the platform 80, as best shown in FIG. 3. Preferably, the platform 80 is coated with a friction enhancing substance 82, such as silicon carbide powder placed in a layer of a conventional adhesive. The purpose of the substance 82 is to inhibit sliding of a label 52 being held on the platform 80. The rotary actuator is set so that at one extreme of travel of the wheel 70 (counterclockwise or upward rotation as viewed in FIG. 3), the platform 80 an the openings 73 are directly under the magazine 45. In a manner described below, such is created in the radial bores 72, causing the bottom label 52 to be pulled from the magazine onto the platform 80.

The mounting plate 20 of the label injector 10 is positioned so that the wheel 70 is located just inside a hem folding track or cams 83 of conventional construction. The cam 83 gradually guides the edge of the towel first upwardly and then over onto itself in a manner well known to those skilled in the art. A slot 84 is provided in the cam 83 at the intersection of the peripheral surface of the wheel 70 with the plane of the cam 83. The slot 84 allows the portion of a label extending laterally from the surface of the wheel to be carried within the fold being formed by the cam just before the material of the towel is folded over itself.

Figure 9:
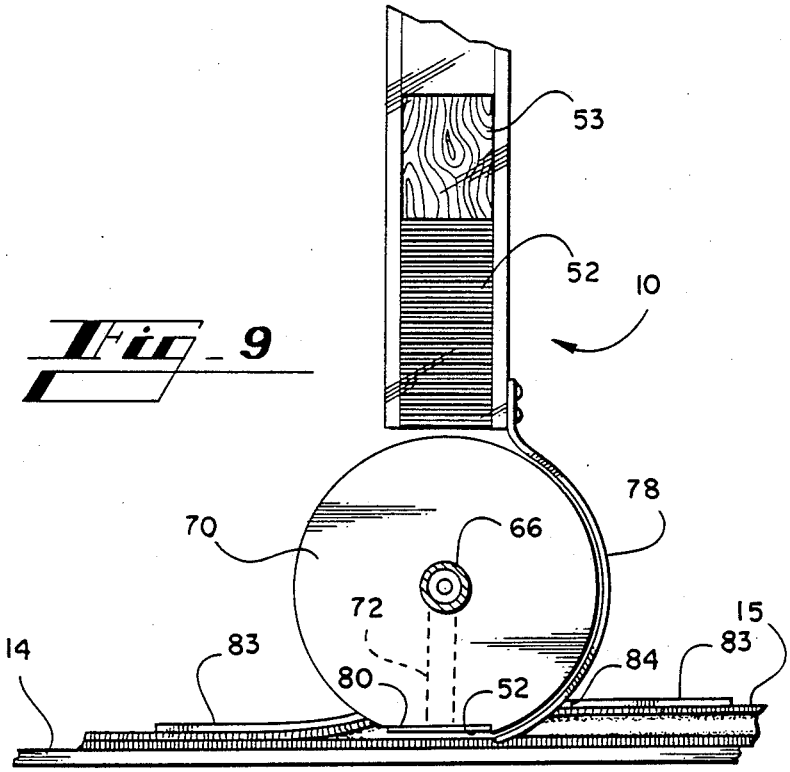
FIG. 9 is an isolated side view of the magazine and applicator wheel of the label injector of FIG. 2, showing the wheel in position to release a label onto the workpiece.

A skirt 78, formed of smooth, flexible metal or plastic, is attached to the front of the magazine and closely follows the contour of the wheel 70 to a position generally under the wheel. The skirt 78 passes through the slot 84 in the folding cam 83 and terminates short of the down position of the platform 80 as shown in FIG. 9. The skirt is not essential to the operation of the invention, although it tends to improve the consistency of performance.

The interior of the axle 66 and the applicator wheel 70 is shown in FIG. 6. The axle 66 defines a longitudinal passageway 85 which is divided into three sections. An entrance section 86 is adjacent to the bearing 65, and receives a pneumatic fitting 87 threaded into a tapped opening at the end of the entrance section 86. The fitting 87 is connected to an air line 88 which supplies positive air pressure to the passageway 85. Such air passes into a venturi throat 90 at the other end of the entrance section 86. The venturi throat opens into an exit section 91, which defines a radial opening 92 positioned to communicate with the radial bore 72 of the applicator wheel 70. As noted above, the end of the axle 66 is attached to the coupling 67. The coupling 67 is hollow, and the exit section 91 communicates with the interior chamber 94 of the coupling 67. Several exhaust openings 95 are formed in the coupling connecting the chamber 94 with the exterior.

Thus, it will be seen the pressurized air forced into the entrance section 86 is regulated by the venturi 90 and passes around the radial bores 72. The air exiting the venturi throat expands, adding to the negative pressure created in the radial bores and at the openings 73. The air passes on through the exit section 91, into the chamber 94, and out the openings 95 to atmospheric pressure. In the preferred embodiment, the entrance section may be 1.75 inches long and 5/16 inch in diameter, the venturi section ½ inch long and 7/64 inch in diameter, and the exit section 2.25 inches long and ⅜ inch in diameter. The radial bores may be approximately ⅜ inch in diameter, and separated by about 3/16 inch at the platform 80. The bridge of material of the platform separating the openings 73 prevents labels from being sucked into the bores 72. Those skilled in the art will realize that such dimensions may be varied according to the available air supply, the nature of the labels, and the construction of the magazine. It will also be apparent that a vacuum pump could be connected to the radial bores 72 to provide suction at the openings 73.

Figure 2:
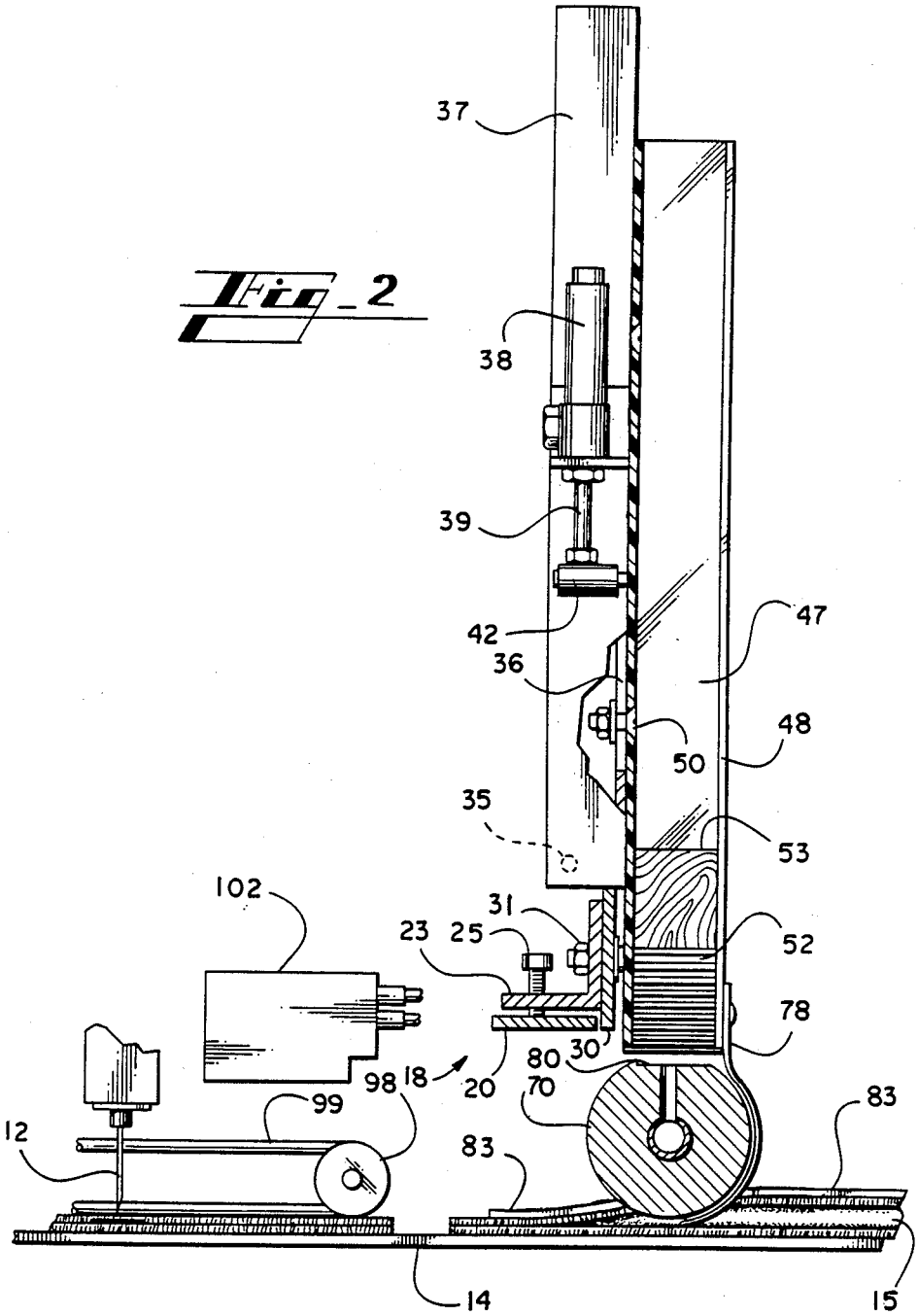
FIG. 2 is a vertical cross sectional view of the apparatus of FIG. 1, taken along line 2—2 of FIG. 1.
Figure 3:
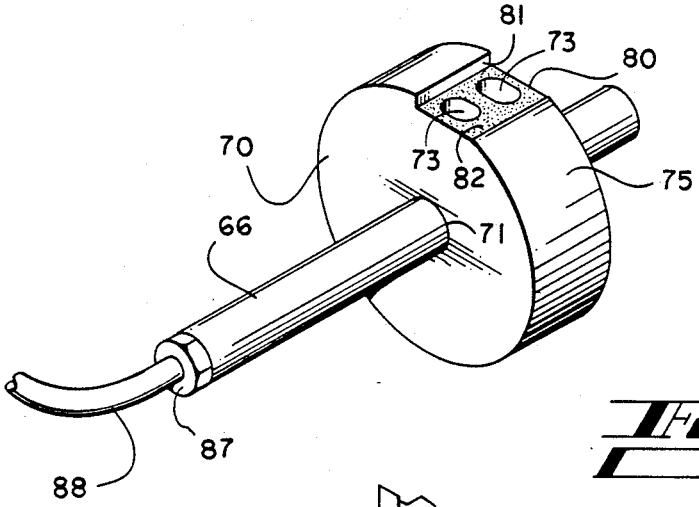
FIG. 3 is an isolated pictorial view of the applicator or vacuum wheel of the label injector of FIG. 1.
Figure 4:
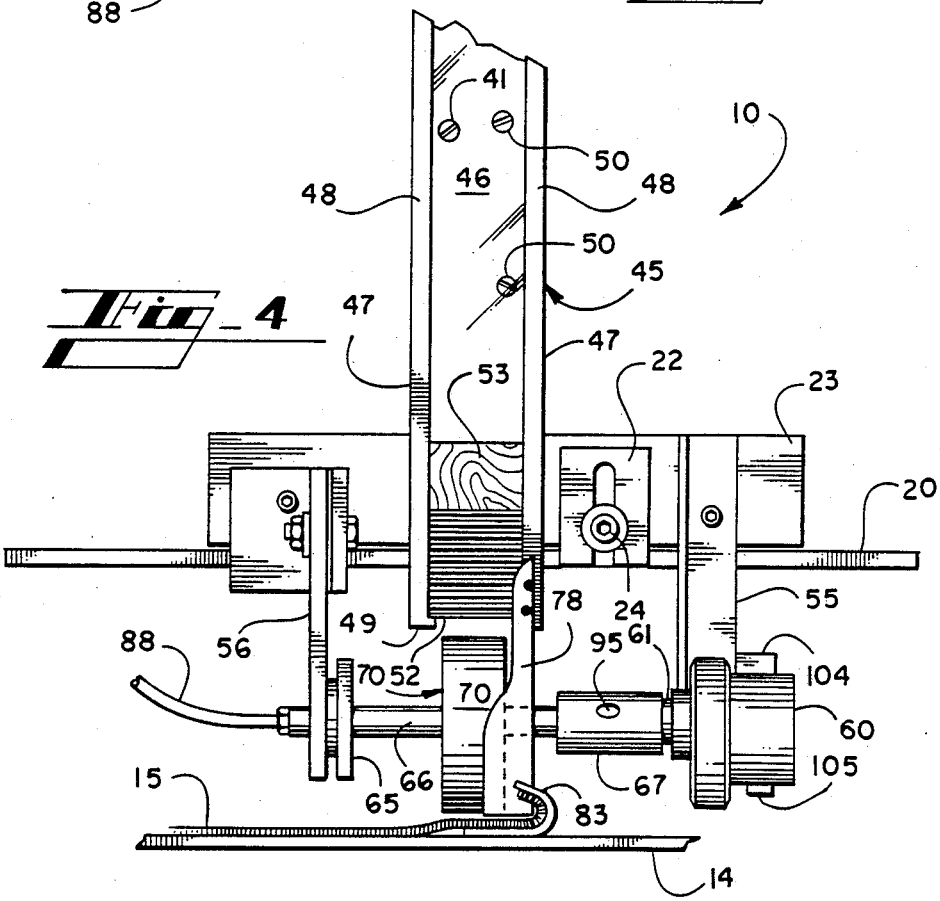
FIG. 4 is a front plan view of the label injector of FIG. 1, showing its relationship to the workpiece being hemmed.
Figure 5:
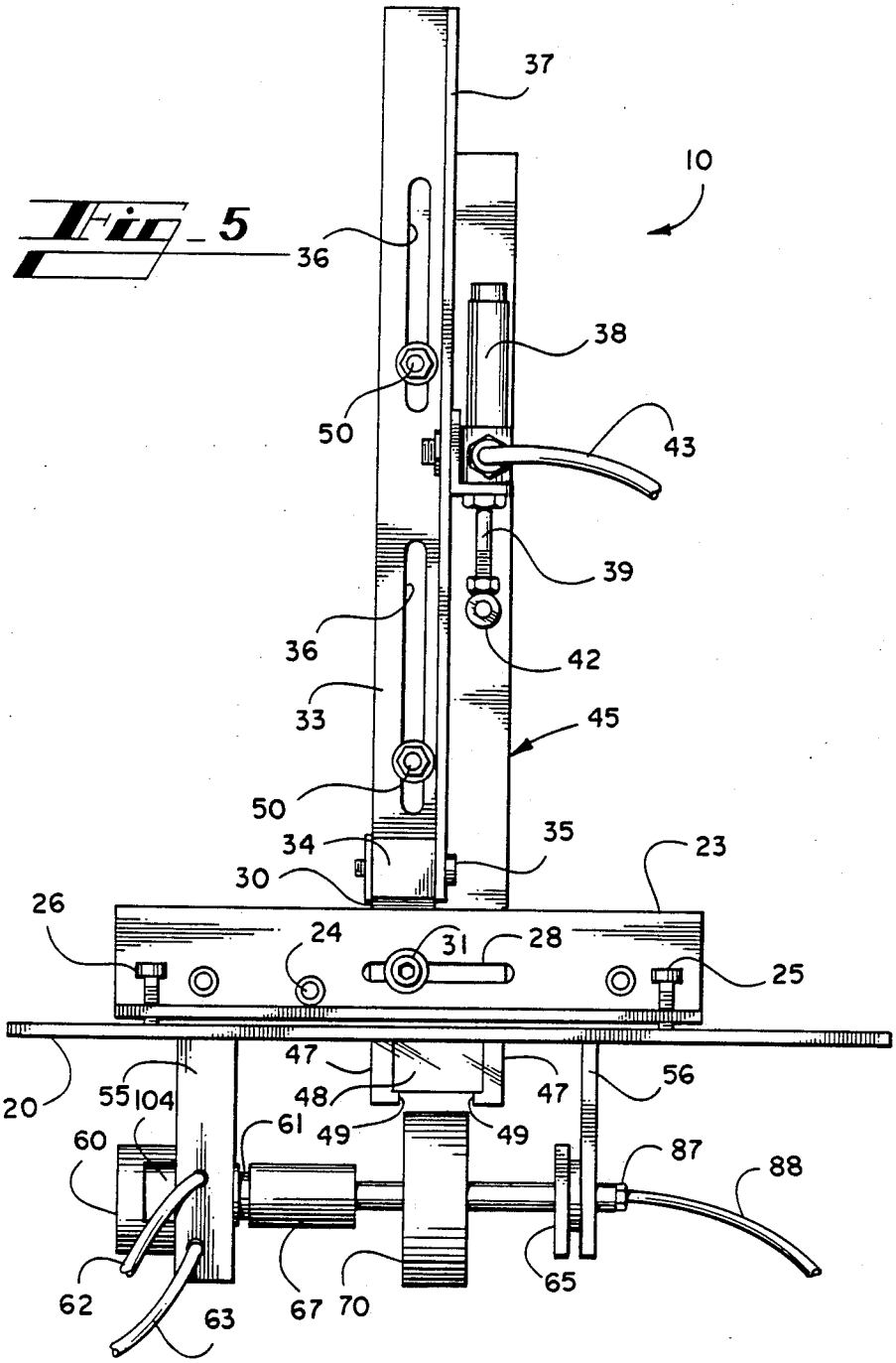
FIG. 5 is a rear plan view of the label injector of FIG. 1.

Referring now to FIG. 2, a belt 99 passes around a pulley 98, positioned above the path of the workpiece between the wheel 70 and the sewing machine 12. The lower run of the belt 99 extends closely adjacent to the path of the workpiece through and beyond the point at which the sewing machine sews a hem stitch into the workpiece. Thus, the belt 99 holds down a label released onto the workpiece from the wheel 70.

An infrared scanner 102 of conventional construction is positioned between the wheel 70 and the sewing machine 12, and is capable of detecting the passing of the leading edge of the workpiece. The scanner 102 may be mounted from the structure of the table 14 or attached to a bar (not shown) mounted on the label injector mounting plate 20. Preferably, the position of the scanner is made adjustable.

A normally closed reset limit switch 104 is positioned to be struck by a projection 105 on the rotary actuator 60 when the wheel 70 has travelled downwardly a distance sufficient to orient the platform 80 over the workpiece. The opening of the limit switch 104 results in the return of the wheel to tis original position through the operation of a control circuit described below.

The label injector 10 is operated using two control circuits, one of which is the pneumatic control circuit 110 shown in FIG. 6. A source of pressurized air at 60–80 PSI, preferably 80 PSI, is connected to the air lines 43, 62, 63, and 88. The line 43, connected to the cylinder 38, includes a solenoid operated valve 112 and a metering valve 113. The lines 62 and 63, connected to the down and up ports, respectively, of the rotary actuator 60, include solenoid operated valves 114 and 115, and metering valves 116 and 117. The line 88 includes a solenoid operated valve 118. The solenoid valves operate the piston rod to move the magazine, switch the rotary actuator position, and turn the suction on and off. Details of the operation are set out below.

Figure 7:
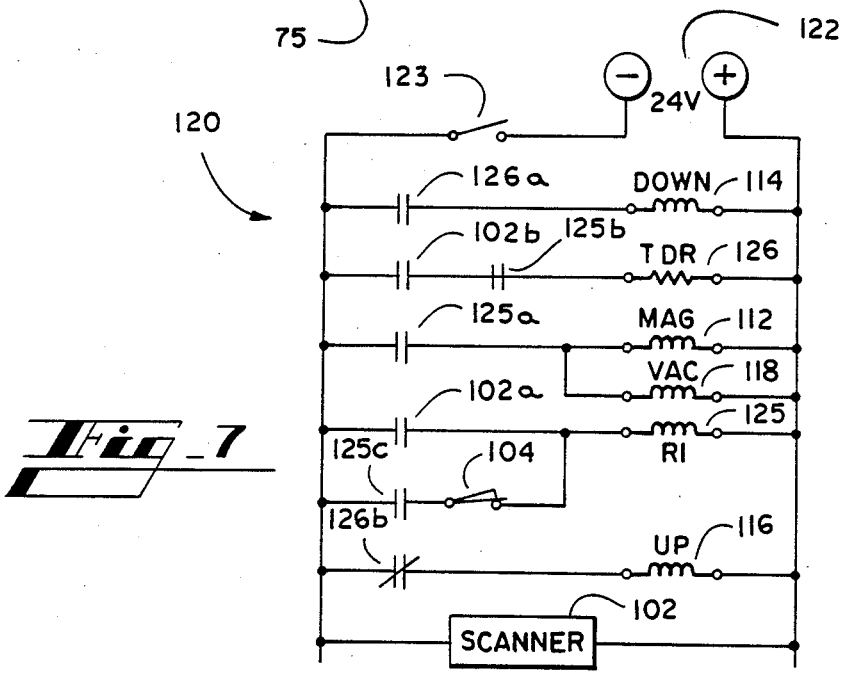
FIG. 7 is a schematic representation of the electrical control circuit of the present invention.

An electrical control circuit 120, shown in FIG. 7, operates the solenoid valves. A 24 volt power supply 122 is turned on and off by a power switch 123, supplying power to the infrared scanner 102, solenoid valve 115 (rotary actuator up), and to a three pole, double throw relay 125 when the scanner detects a workpiece and closes contacts 102*a*. The relay may be, for example, a Potter & Brumfield Model AMF KRP A14BN relay. Energization of the relay 125 closes contacts 125*a*, operating solenoid valves 118 (suction on) and 112 (magazine up). Activation of the scanner 102 also closes contacts 102*a* and energizes a time delay relay 126, which times out and provides a signal after about 0.3 seconds. Timing out the relay 126 closes contacts 126*a*, operating solenoid valve 114, providing air pressure to the down port of the rotary actuator. Timing out of the relay 126 also opens normally closed contacts 126*b*, which deactivates solenoid valve 116, terminating air to the up port of the rotary actuator.

The relay 125 is also connected to the power supply in parallel through contacts 125*c*, and the normally closed limit switch 104. Thus, the closing of the scanner contacts 102*a* energizing the relay 125 is immediately followed by closing of the contacts 125*c*, which maintain power to the relay until motion of the rotary actuator 60 opens the limit switch 104, deactivating the relay 125. At this event, the relay contacts 125*a*, 125*b*, and 125*c* reverse, and the suction is turned off. Furthermore, deactivation of the relay 125 also resets the time delay relay 126, opening contacts 126*a* and closing normally closed contacts 126*b*. This causes the wheel 70 to return to its up position under the magazine. When the workpiece clears the scanner 102, the contacts 102*a* and 102*b* open, leaving the circuit in its original state.

Figure 8A:
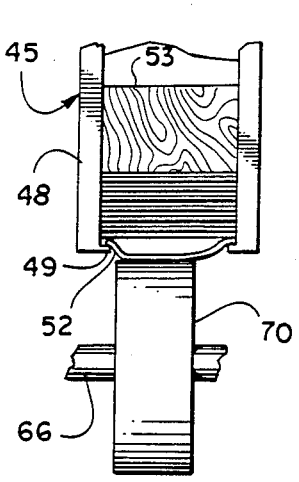
FIGS. 8A, 8B, and 8C show in sequence the manner in which a label is removed from the magazine by the applicator wheel.

In operation of the label injector 10, the operator may load the magazine 45 by sliding a stack of labels 52 down the magazine until they engage the lips 49. The follower weight 53 is placed on top of the stack of labels. The operator then turns on the power switch 123 and feeds the workpiece 15, such as a towel, into the hemming apparatus in a conventional manner. As the towel passes under the scanner 102, the scanner sends a signal closing contacts 102*a* and 102*b*. The relay 125 is energized, as well as the time delay relay 126. This results in switching of the valve 118 to allow pressurized air to flow through the axle 66, creating a vacuum at the openings 73 at the air escapes the venturi section 90 and flows past the opening 92 in the axle. The lowermost label 52 of the stack is pulled partially out of the magazine 45 against the platform 890 on the applicator wheel 70. Since the wheel 70 is offset with respect to the magazine, the label extends laterally beyond the peripheral surface of the wheel toward the edge of the towel being hemmed. The position of the components at this point in operation of the system is shown in FIG. 8A.

Figure 8B:
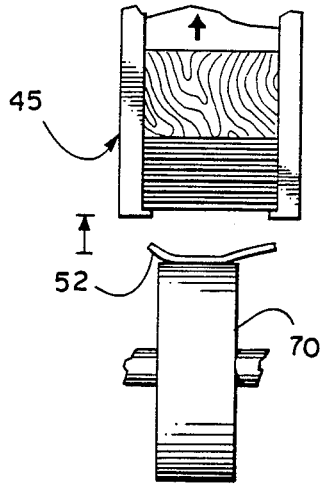

At the same time, the valve 112 is switched, supplying air to the piston 38, raising the piston rod 39 and the magazine 45 about one half inch. As shown in FIG. 8B, the upward motion of the magazine extracts the label 52 from the lips 49 of the magazine. This procedure has been found to extract only one label at a time in a very consistent manner. The skirt 78 is sufficiently flexible that is not removed from the folding cam 83 during upward motion of the magazine to which the skirt is attached.

Figure 8C:
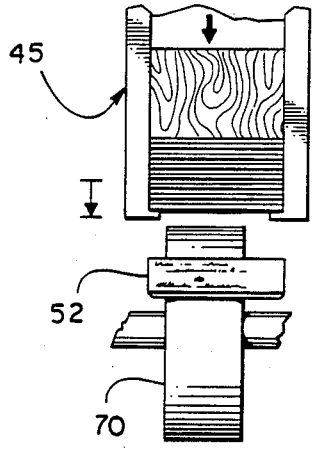

Following the extraction of a label, the time delay relay 126 times out, and the switching of contacts 126*a* and 126*b* causes valves 114 and 116 to switch. Air is cut off from the up port of the rotary actuator 60 and is supplied to the down port, resulting in the rotation of the applicator wheel 70 toward the front as shown in FIG. 8C. The wheel 70 rotates through an angle of about 180 degrees to the position shown in FIG. 9. During motion of the wheel, the label is positioned against the shoulder 81 of the platform 80 formed in the wheel, and the roughened surface 82 of the platform tends to prevent movement of the label relative to the wheel as the label travels under the skirt 78. As the label approaches the folding cam 83, the extending end of the label passes through the slot 84 in the cam 83, clears the end of the skirt 78, and is in position to be folded into the hem being formed by the cam. The skirt 78 prevents the pile or loop material of the towel from disorienting the label as it passes under the wheel.

When the wheel 70 reaches the position shown in FIG. 9, with the label positioned above the web of the towel 15 and within the folded hem, the projection 105 on the moving portion of the rotary actuator 60 trips the limit switch 104. This deenergize the relay 125. Opening of the contacts 125*a* switches back the valve 112 to allow the magazine to move back to its original down position, and switches back the valve 118 to remove the vacuum from the openings 73. The label 52 is thus released onto the towel 115. Opening of the contacts 125*b* resets the time delay relay. Upon the opening of the contacts 126*a* and closing of the contacts 126*b*, the air pressure is removed from the down port of the rotary actuator 60 and connected to the up port. The wheel 70 thereby rotates back up to position the platform 80 under the magazine. The limit switch 104 is released and once again closes.

The movement of the towel 15, which has not slowed or stopped during the insertion of the label, continues as the wheel rotates back to its starting position. After the label is released, it is immediately trapped within the hem as the towel material is folded across the label by the shape of the cam 83. The label is carried within the hem until it is pressed against the towel by the belt 99 and subsequently sewn into the hem at the sewing machine 12. When the trailing end of the towel clears the scanner 102, the scanner resets, opening the contacts 102*a* and 102*b*. Now the injector system is ready to place a label on the next towel inserted by the operator.

Figure 10:
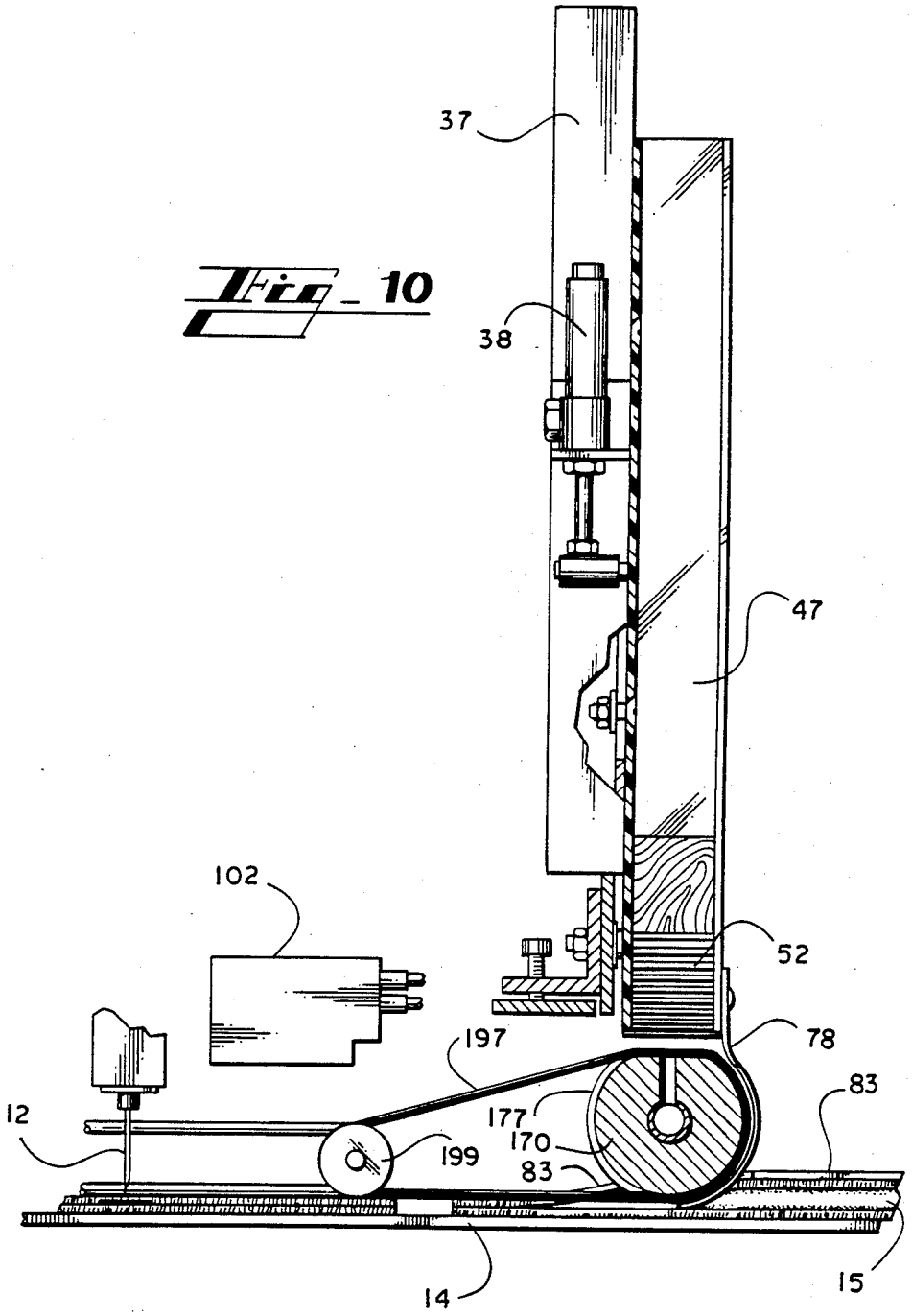
FIG. 10 is a side view of another embodiment of the present invention according to which a belt surrounds the applicator wheel.
Figure 11:
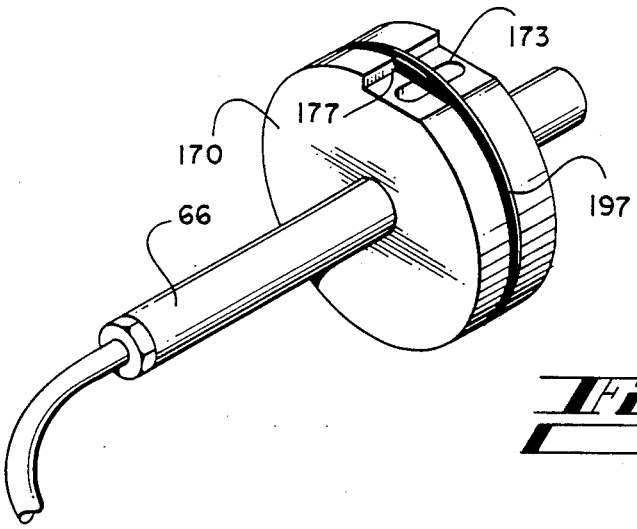
FIG. 11 is an isolated pictorial view of the applicator wheel of the embodiment of the invention shown in FIG. 10.

Referring now to FIGS. 10 and 11, a second embodiment 160 of a label injector according to the present invention is shown. The mounting structure, magazine construction, vacuum system, and control systems are similar to those described above in connection with the first embodiment. A peripheral groove 177 is formed in the peripheral surface around the circumference of a wheel 170. A belt 197, preferably having a round cross section, is received in the peripheral groove 177 of the wheel 170. The belt 197 wraps around the side of the wheel facing away from the sewing machine 12, and also passes around a double pulley 198 positioned above the path of the workpiece between the wheel 170 and the sewing machine 12, in place of the pulley 98 previously described. Thus, the horizontal run of the belt 197 between the bottom of the wheel 170 and the pulley 198 passes closely adjacent to the path of the workpiece 15 on the table 14. At the pulley 198, the hold down function of the belt 197 is transferred to the belt 97 described above.

As shown in FIG. 11, the wheel 170 according to the second embodiment has only one radial bore and one surface opening 173. The belt 197 crosses the opening 173 and serves to prevent labels from being sucked into the opening. During operation, the belt helps to position the label on the moving wheel 170, the holds the label on the towel immediately after the label is released from the suction platform of the wheel. As the wheel returns upwardly, it slips within the belt.

Figure 12:
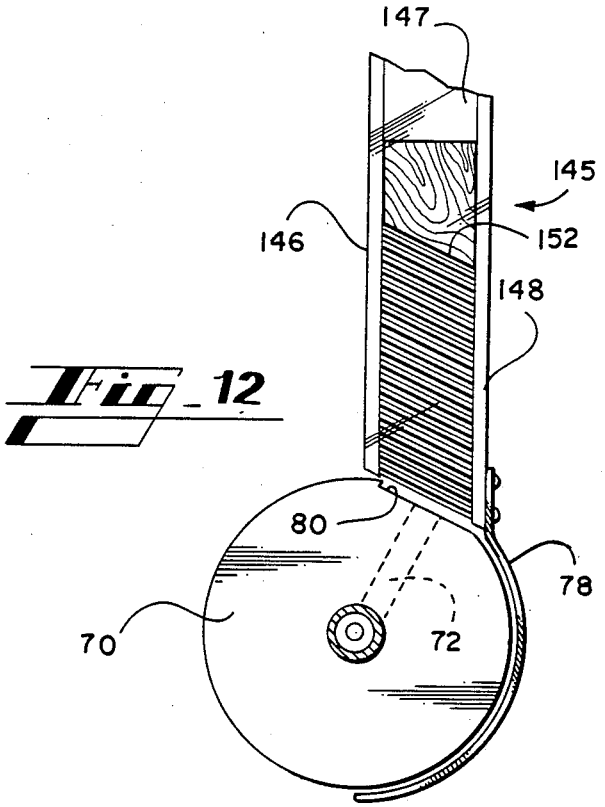
FIG. 12 is a vertical cross sectional view of a alternate embodiment of a label magazine which can be used with the present invention.

FIG. 12 shows an alternate embodiment of a label magazine 145 for use with thicker labels 152, particularly those labels that have been folded into a double thickness prior to insertion into the magazine. Most prior label injectors cannot successfully handle such labels. The magazine 145 includes a back wall 146 and side walls 147 which are angled downwardly toward the front of the magazine. Front corner flanges 148, longer than the back wall 146, retain the labels within the magazine. A follower 153 having an angled bottom portion is placed on the stack of labels. No bottom lips corresponding to the lips 49 in the first embodiment are utilized.

As shown in FIG. 12, the magazine 145 is positioned forward of the center of the applicator 70, and the labels 152 rest directly on the peripheral surface of the wheel 70 at an angle. When the suction is turned on, the bottom label is adhered to the platform of the wheel, and the shoulder assists in separating the bottom label from those above. The thickness of the labels is such that only one label will be removed. The magazine is not raised during label extraction as was the ease with the first embodiment described above. As the wheel turns, the remaining labels 152 are held within the magazine by the passing smooth surface of the wheel 70. When the platform returns, the shoulder slips past the trailing edge of the next label, when then lies on the platform until the next towel is fed through the apparatus.

It will thus be seen that the present invention provides a greatly improved method and apparatus for placing labels into the hem of towels moving through a hemming apparatus. The label injector of the invention consistently extracts a single label and accurately places it into the hem being formed. The label injector can easily be removed from the production line without altering its internal adjustments, and itself has few moving parts. The label is transferred positively onto the moving towel without exchange between various transfer elements as was common in the prior art. Little opportunity exists for the label to become disoriented during the transfer process.

While this invention has been described in detail with particular reference to preferred embodiments thereof, it will be understood that variations and modifications can be effected within the spirit and scope of the invention as described hereinbefore and as defined in the appended claims.

We claim:

1. An apparatus for placing labels and the like onto a moving workpiece, comprising:

a magazine containing a plurality of labels;

an applicator wheel positioned between said magazine and a moving workpiece and rotatable about an axis perpendicular to the direction of movement of said workpiece, said applicator wheel including means for removing a label from said magazine and retaining said label on said applicator wheel;

means for rotating said applicator wheel relative to said workpiece while said label is retained on said applicator wheel until said label is located between said applicator wheel and said workpiece;

means for releasing said label from said applicator wheel, whereby said label is placed upon said workpiece; and means for returning said applicator wheel to its original orientation prior to removing said label from said magazine.

2. The apparatus of claim 1, further comprising a guide skirt flexible positioned between said workpiece and said applicator wheel and extending under said applicator wheel to a point adjacent to the location at which said label is released.

3. The apparatus of claim 2, wherein said guide skirt comprises an arcuate guide surface extending closely adjacent to said applicator wheel from the bottom of said magazine to said point adjacent to the location at which said label is released.

4. The apparatus of claim 1, wherein said wheel defines a peripheral surface for receiving said label, and wherein said means for removing and retaining said label comprises means for creating suction through an opening in said peripheral surface toward the interior of said wheel.

5. The apparatus of claim 4, further comprising control means for detecting an approaching workpiece and means for activating said suction means and said applicator wheel rotating means responsive to detection of an approaching workpiece.

6. The apparatus of claim 1, wherein said wheel defines a peripheral surface for receiving said label, and wherein said means for rotating said applicator wheel comprises means for moving said peripheral surface at substantially the same speed as said workpiece.

7. The apparatus of claim 1, wherein said applicator wheel defines a peripheral surface for receiving and retaining said label, and wherein said magazine positions said labels in a stack resting on the surface of said applicator wheel, such that as one label is removed from said magazine and moved with said peripheral surface, the peripheral surface slides past the next label in said magazine.

8. An apparatus for placing labels or the like onto a moving workpiece, comprising:

a magazine containing a plurality of labels;

an applicator wheel positioned between said magazine and a moving workpiece and rotatable about an axis perpendicular to the direction of movement of said workpiece, said applicator wheel defining a peripheral surface and including means for removing a label from said magazine and retaining said label on said peripheral surface including means for creating suction through an opening in said peripheral surface toward the interior of said wheel, said peripheral surface being interrupted by a flattened portion surrounding said opening and a shoulder along the trailing edge of said flattened portion, said trailing edge being spaced inwardly from said peripheral surface;

means for rotating said applicator wheel relative to said workpiece while said label is retained on said applicator wheel until said label is located between said applicator wheel and said workpiece; and means for releasing said label from said applicator wheel, whereby said label is placed upon said workpiece.

9. The apparatus of claim 8, wherein said peripheral surface further defines a circumferential groove and a belt positioned in said groove, said belt crossing said opening and extending above said peripheral surface to engage said label.

10. The apparatus of claim 9, wherein said means for rotating said applicator wheel comprises means for moving said peripheral surface and said belt at substantially the same speed as said workpiece.

11. An apparatus for placing labels or the like onto a moving workpiece, comprising:

a magazine containing a plurality of said labels;

an applicator wheel positioned between said magazine and said workpiece, a moving applicator wheel defining a peripheral surface including an opening therein and a circumferential groove crossing said opening;

a belt positioned in said groove and extending above said peripheral surface;

a hollow axle on which said wheel is mounted, the interior of said axle being connected to said opening in said peripheral surface by a radial bore;

means for creating suction into said wheel at said opening capable of removing a label from said magazine and retaining said label on said peripheral surface;

means for rotating said applicator wheel relative to said workpiece at substantially the same speed as the movement of said workpiece, while said label is retained on said applicator wheel, until said label is pressed against said workpiece by said belt; and means for terminating said suction while said label is trapped between said belt and said workpiece, whereby said label is accurately positioned upon said workpiece.

12. A method of placing labels or the like onto a moving workpiece, comprising the steps of:

withdrawing a label from a magazine by applying suction to said label from an opening on the peripheral surface of a wheel positioned between said magazine and a moving workpiece;

retaining said label on said wheel;

moving said wheel relative to said workpiece while said label is retained on said peripheral surface until said label is positioned between said wheel and said workpiece; and releasing said label from said wheel, whereby said label is placed upon said workpiece.

13. The method of claim 12, wherein said step of withdrawing said label comprises applying said suction responsive to detection of an approaching workpiece.

14. The method of claim 13, further comprising the step of returning said applicator member to its original orientation prior to withdrawing said label.

15. The method of claim 12, wherein said step of moving said wheel comprises moving said peripheral surface at substantially the same speed as said workpiece.

16. A positioning apparatus comprising:

a magazine containing a plurality of labels;

an applicator wheel positioned between said magazine and a moving workpiece and rotatable about an axis perpendicular to the direction of movement of said workpiece, said applicator wheel including a means for creating suction through an opening in a peripheral surface defined by said applicator wheel and for removing a label from said magazine and retaining said label on said applicator wheel;

means for folding a hem in said workpiece; and means for rotating said applicator wheel relative to said workpiece while said labels are retained on said applicator wheel until said label is located between said applicator wheel and said workpiece, and for releasing said label from said applicator wheel within a partially folded hem;

whereby said label is placed within said fold of said workpiece.

17. A method for placing labels within a fold of the hem of a moving workpiece comprising steps of:

positioning an applicator wheel between a magazine containing a plurality of labels and a moving workpiece;

removing a label from said magazine;

placing said label on a peripheral surface defined by said wheel;

rotating said applicator wheel relative to said workpiece while partially folding a hem along an edge of said workpiece;

retaining said label on said applicator wheel until said label is located between said applicator wheel and said workpiece within said partially folded hem;

releasing said label from said applicator wheel within said partially folded hem; whereby said label is placed within said fold of said workpiece; and returning said applicator wheel to its original orientation prior to removing another of said labels from said magazine.

18. An apparatus for placing labels or the like onto a moving workpiece, comprising:

a magazine containing a plurality of labels;

an applicator wheel positioned between said magazine and a moving workpiece and rotatable about an axis perpendicular to the direction of movement of said workpiece, said applicator wheel including means for removing a label from said magazine and retaining said label on said applicator wheel;

means for rotating said applicator wheel relative to said workpiece while said label is retained on said applicator wheel until said label is located between said applicator wheel and said workpiece;

means for releasing said label from said applicator wheel, whereby said label is placed upon said workpiece; and a guide skirt positioned between said workpiece and said applicator wheel and extending under said applicator wheel to a point adjacent to the location at which said label is released.

19. An apparatus for placing labels or the like onto a moving workpiece, comprising:

a magazine containing a plurality of labels;

an applicator wheel positioned between said magazine and a moving workpiece and rotatable about an axis perpendicular to the direction of movement of said workpiece, said applicator wheel including means for removing a label from said magazine and retaining said label on a peripheral surface defined by said applicator wheel, comprising means for creating suction through an opening in said peripheral surface toward the interior of said wheel;

means for rotating said applicator wheel relative to said workpiece while said label is retained on said applicator wheel until said label is located between said applicator wheel and said workpiece; and means for releasing said label from said applicator wheel, whereby said label is placed upon said workpiece.

20. The apparatus of claim 4, wherein said magazine includes a withdrawal opening partly crossed by a lip; and further comprising means for moving said magazine away from said suction means, such that said label grasped by said suction means is pulled from behind said lip and removed from said magazine.

21. The apparatus of claim 4, wherein said means for creating suction comprises a hollow axle on which said wheel rotates, a radial bore connecting the interior of said axle with said opening, and means for passing air through said axle across the entrance to said radial bore.

22. The apparatus of claim 21, further comprising a second radial bore extending from said hollow axle to a second opening on said peripheral surface.

23. The apparatus of claim 21, wherein said openings are located in a flattened portion of said peripheral surface, said flattened portion receiving said labels from said magazine and said flattened portion being spaced inwardly from said peripheral surface along the trailing edge of said flattened portion.

24. The apparatus of claim 23, wherein said flattened portion comprises a non-slip surface.

25. The apparatus of claim 19, wherein said peripheral surface defines a flattened portion surrounding said opening and a shoulder along the trailing edge of said flattened portion.

26. The apparatus of claim 25, wherein said peripheral surface further defines a circumferential groove and a belt positioned in said groove, said belt crossing said opening and extending above said peripheral surface to engage said label.

27. The apparatus of claim 26, wherein said means for rotating said applicator wheel comprises means for moving said peripheral surface and said belt at substantially the same speed as said workpiece.

28. An apparatus for placing labels or the like onto a moving workpiece, comprising:

a magazine containing a plurality of labels;

an applicator wheel positioned between said magazine and a moving workpiece and rotatable about an axis perpendicular to the direction of movement of said workpiece, said applicator wheel including means for removing a label from said magazine and retaining said label on a peripheral surface defined by said applicator wheel;

means for rotating said applicator wheel relative to said workpiece while said label is retained on said applicator wheel, comprising means for moving said peripheral surface at substantially the same speed as said workpiece, until said label is located between said applicator wheel and said workpiece; and means for releasing said label from said applicator wheel, whereby said label is placed upon said workpiece.

29. An apparatus for placing labels or the like onto a moving workpiece, comprising:

a magazine containing a plurality of labels;

an applicator wheel positioned between said magazine and a moving workpiece and rotatable about an axis perpendicular to the direction of movement of said workpiece, said applicator wheel including means for removing a label from said magazine and retaining said label on a peripheral surface defined by said applicator wheel;

means for rotating said applicator wheel relative to said workpiece while said label is retained on said applicator wheel until said label is located between said applicator wheel and said workpiece; and means for releasing said label from said applicator wheel, whereby said label is placed upon said workpiece;

said magazine positioning said labels in a track resting on the peripheral surface to said applicator wheel, such that as one label is removed from said magazine and moved with said peripheral surface, the peripheral surface slides past the next label in said magazine.

* * * * *